United States Patent [19]

Lindley

[11] Patent Number: 4,592,103

[45] Date of Patent: Jun. 3, 1986

[54] LEDGE BED APPARATUS WITH SAFETY ENGAGING MECHANISM

[76] Inventor: William L. Lindley, P.O. Box 3105, Conroe, Tex. 77305-3105

[21] Appl. No.: 684,628

[22] Filed: Dec. 21, 1984

[51] Int. Cl.[4] ..... A61G 7/06; A61G 7/02

[52] U.S. Cl. ..... 5/65; 5/90; 5/72; 5/312

[58] Field of Search ..... 5/65, 64, 63, 90, 70, 5/71, 72, 77, 80, 312

[56] References Cited

U.S. PATENT DOCUMENTS

| | | | |
|---|---|---|---|
| 2,834,401 | 5/1958 | Tanner . | |
| 2,994,093 | 8/1961 | Wagner | 5/75 |
| 3,305,876 | 2/1967 | Hutt | 5/11 |
| 3,676,881 | 7/1972 | Duprey | 5/63 |
| 4,435,861 | 3/1984 | Lindley | 5/65 |
| 4,461,047 | 7/1984 | Lindley | 5/63 |

*Primary Examiner*—Alexander Grosz

*Attorney, Agent, or Firm*—Pravel, Gambrell, Hewitt & Kimball

[57] ABSTRACT

A ledge bed apparatus for use with a patient care bed having a vertically movable bed frame. The apparatus includes a mattress support member adapted to be positioned on the bed frame and a leg assembly. The leg assembly includes an upper leg portion depending from the mattress support member and a lower leg portion pivotally attached to the upper leg portion which is pivotable into substantially vertical alignment therewith. The leg assembly also includes means for locking the upper and lower leg portions in alignment when the lower leg portion is first pivoted into alignment with the upper leg portion and the leg assembly is subsequently vertically loaded by lowering the bed frame so that the lower leg portion engages a load bearing surface and a portion of the mattress support member is supported by the leg assembly in a position elevated with respect to the bed frame, thereby forming a ledge. In addition, the leg assembly includes automatic means for releasing the locking means and pivoting the lower leg portion at an angle with respect to the upper leg portion when the vertical loading is removed by raising the mattress support member so that the lower leg portion is disengaged from the load bearing surface, thereby removing the ledge. In this manner, accidental formation of a ledge when the bed is inadvertently lowered is prevented.

24 Claims, 10 Drawing Figures

LEDGE BED APPARATUS WITH SAFETY ENGAGING MECHANISM

FIELD OF THE INVENTION

The present invention relates to a ledge bed apparatus which is adapted for use in hospitals, nursing homes and the like where it is desirable to position a bed pan or bathtub beneath a patient lying in bed without a hospital attendant having to physically lift the patient, and particularly to such an apparatus which is provided with a safety engaging mechanism which must be manually operated to permit formation of a ledge when the bed is lowered, and when the bed is raised to remove the ledge, which automatically releases the manually operable engagement mechanism so that a subsequent inadvertent lowering of the bed will not result in formation of the bed ledge.

BACKGROUND OF THE INVENTION

Generally, conventional patient care beds provide for inclination of both the head and foot sections of the bed. Such inclination is typically obtained by inclining the head or foot mattress support sections which are pivotally connected to the bed's main frame. Inclination of either the head or foot section of a conventional patient care bed provides no configuration of the bed mattress whereby a hospital attendant may position a bed pan or bath tub beneath the patient without physically lifting or moving the patient.

In applicant's earlier application, Ser. No. 352,348, now U.S. Pat. No. 4,435,861, there is described a ledge bed including a stiff leg assembly pivotally connected to the head mattress support. The stiff leg assembly can be vertically positioned so that when the main frame is lowered, the stiff leg assembly will engage the floor surface whereupon the head mattress support will form a ledge vertically displaced above the foot mattress support. When the bed is to be lowered without forming a ledge, the stiff leg assembly is tied or otherwise secured to the main frame at an angle with respect to the vertical such that when the bed is lowered, the stiff leg assembly will not engage the floor. Similarly, in applicant's earlier application, Ser. No. 391,126, now U.S. Pat. No. 4,461,047, there is described a ledge bed overlay cooperatively used with a conventional patient care bed. In that patent, there is described a ledge bed overlay apparatus which includes a stiff leg assembly pivotally attached to the mattress support member which is maintained in a retracted position when not in use and is positioned vertically to be operative.

In both of the applicant's aforementioned patents, the stiff leg of the ledge bed device must be manually positioned and secured to render it inoperative. Unless the stiff leg is manually secured, the stiff leg assembly will remain in the operable position upon raising the bed from the ledge forming position. The patient attendant may thus inadvertently leave the stiff leg assembly in the operable position so that the ledge is formed if the bed is lowered. Moreover, such hospital beds are typically equipped with a lowering device which when actuated lowers the bed to the lowermost position. Thus, it is possible for the attendant to leave the stiff leg assembly in an operable position, actuate the bed lowering mechanism and leave the patient's room before the bed is lowered into its lowermost position in which a ledge is formed, leaving the patient in an uncomfortable position until the patient is able to summon assistance in removing the ledge.

SUMMARY OF THE INVENTION

Briefly, the ledge bed apparatus of the present invention includes (a) a mattress support member and (b) a leg assembly which includes (i) an upper leg portion attached to the mattress support member which extends substantially vertically therebeneath, (ii) a lower leg portion pivotally attached to the upper leg portion and which is pivotable into substantially vertical alignment therewith, (iii) means for locking the lower leg portion in alignment with the upper leg portion when the lower leg portion is first pivoted into alignment with the upper leg portion and the leg assembly is subsequently vertically loaded by lowering the bed frame so that the lower leg portion engages the floor or other load bearing surface and at least a portion of the mattress support member is supported by the leg assembly in a position elevated with respect to the bed frame, thereby forming a ledge, and (iv) automatic means for releasing the locking means and positioning the lower leg portion at an angle with respect to the upper leg portion when the vertical loading is removed by raising the mattress support member so that the lower leg portion is disengaged from the load bearing surface, thereby removing the ledge. Thus, when the bed is raised from the ledge-forming position, the leg assembly is automatically retracted from the operable, load bearing surface engagement position preventing an inadvertent formation of the ledge on subsequent lowering of the bed frame. The structure of the present ledge bed apparatus requires manual pivoting of the lower portion of the leg assembly to be placed in the operable position.

The structure of the present invention may be incorporated into a ledge bed overlay apparatus for cooperative use with a conventional patient care bed, or alternatively, may be incorporated into the integral structure of the patient care bed.

DETAILED DESCRIPTION OF THE PREFERRED EMBODIMENTS

Figure 1:
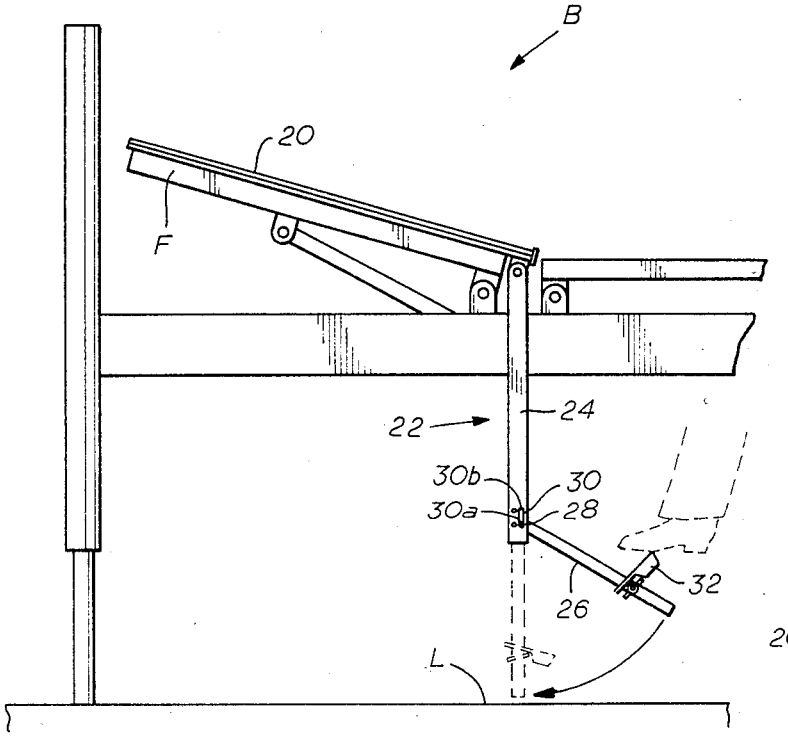
FIG. 1 is a perspective side view of a portion of a patient care bed equipped with a ledge bed apparatus showing manual positioning of the leg assembly into the operable position with the bed in a raised position according to the present invention.
Figure 10:
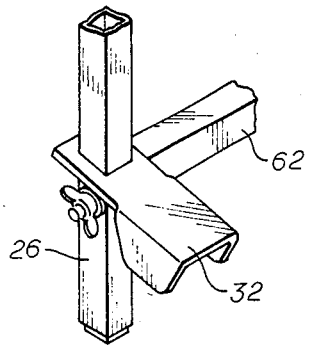
FIG. 10 is a perspective view of a portion of a leg assembly equipped with a toe pad according to the present invention.
Figure 2:
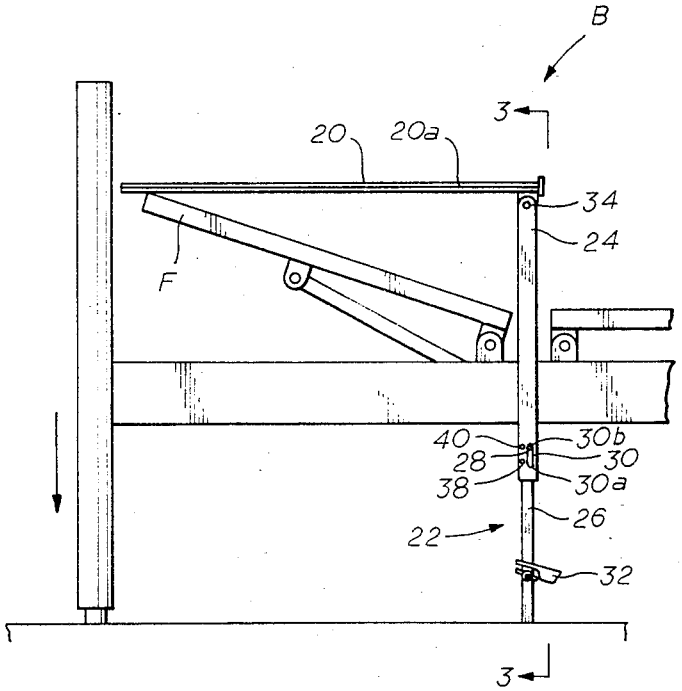
FIG. 2 is a perspective side view of a portion of a patient care bed equipped with a ledge bed apparatus showing formation of a ledge with the leg assembly in the operable position and the bed in a lowered position according to the present invention.

The ledge bed apparatus of the present invention is adapted for use with patient care bed B having vertically movable bed frame F as seen in FIGS. 1 and 2. The ledge bed apparatus includes mattress support member 20 shown positioned on bed frame F. Leg assembly 22 includes upper leg portion 24 and lower leg portion 26. The leg assembly portions are attached to each other by pivot pin 28 which is slidably engaged by vertical slot 30 formed in leg assembly 22. Vertical slot 30 has first extreme end 30*a* at which pivot pin 28 may be positioned to pivot lower leg portion 26 when bed frame F is in a sufficiently elevated position as shown in FIG. 1. Vertical slot 30 has second extreme end 30*b* at which pivot pin 28 may be positioned with lower leg portion 26 in vertical alignment and in telescopic engagement with upper leg portion 24 to prevent pivoting of lower leg portion 26 with respect to upper leg portion 24 as shown in FIG. 2.

In operation, lower leg portion 26 of leg assembly 22 is pivoted into vertical alignment with upper leg portion 24 by pushing lower leg portion 26 down with the foot at toe pad 32, as shown in FIG. 1, against the force exerted in the opposite direction by the automatic releasing means discussed in more detail hereinbelow. With leg assembly 22 held in vertical alignment, bed frame F is vertically lowered so that lower leg portion 26 engages load bearing surface L. With continued lowering of bed frame F, leg assembly 22 begins to support mattress support member 20, thereby becoming vertically loaded. Lowering of bed frame F also causes lower leg portion 26 to telescope into upper leg portion 28, thereby locking the leg assembly into vertical alignment and preventing pivoting. With continued lowering of bed frame F, mattress support member 20 becomes elevated with respect to bed frame F at the point of attachment 34 of mattress support member 20 to leg assembly 22, thereby forming a ledge on the bed which can support the upper torso section of a patient lying thereon to permit a hospital attendant to place a bed pan or bathtub under the patient without physically lifting the patient.

When it is desired to remove the ledge, bed frame F is raised until mattress support member 20 comes to rest on bed frame F, thereby removing the ledge. As bed frame F is moved further upward, the automatic releasing means urges lower leg portion 26 to telescope outwardly from upper leg portion 28. Simultaneously, pivot pin 28 moves from the locked position at second extreme end 30*b* of vertical slot 30 to the pivotable position at first extreme end 30*a* of vertical slot 30. With continued raising of bed frame F, the vertical load is removed from leg assembly 22 and lower leg portion 26 disengages load bearing surface L and the automatic releasing means causes lower leg portion 26 to pivot from alignment with upper leg portion 24. When the bed frame is in the raised position, the automatic releasing means maintains lower leg portion 26 pivoted from vertical alignment with upper leg portion 24, so that if bed frame F is subsequently lowered, lower leg portion 26 will not engage load bearing surface L unless lower leg portion 26 is first manually pivoted and maintained in alignment with upper portion 24 during the lowering until leg assembly 22 is vertically loaded. Thus, the ledge bed apparatus of the present invention eliminates the necessity of manually retracting the leg assembly to an inoperable position and avoids the possibility of inadvertently forming a ledge on subsequent lowering of the bed frame as could be occasioned in the prior art devices.

A preferred embodiment of the automatic releasing means is illustrated in FIGS. 4–9. Piston 50 is housed in upper leg portion 24 and is loaded by spring 52 which may be adjusted as required by means of set screw 54 and block 56 so that spring 52 has an adequate separating force to urge lower leg portion 26 to pivot with respect to upper leg portion 24 when leg assembly 22 is not vertically loaded, and yet not so great as to not permit telescoping of lower leg portion 26 into upper leg portion 24 when leg assembly 22 is vertically loaded.

Piston 50 is provided with full bore portion 50*a* and projecting portion 50*b*. Full bore portion 50*a* has a shape which corresponds to the piston housing formed in upper leg portion 24 for maintaining piston 50 in proper alignment. The piston housing and piston 50 should have a transverse cross-sectional shape which prevents rotation of piston 50, preferably rectangular. It is also preferred that piston 50 be constructed of self-lubricating material, such as, for example, nylon. Projecting portion 50*b* of piston 50 permits contact of piston 50 with lower leg portion 26 at a point which is eccentric with respect to pivot pin 28. This arrangement provides a force for urging lower leg portion 26 to pivot with respect to upper leg portion 24. Projecting portion 50*b* should have a sufficient cross-sectional area to permit adequate contact with lower leg portion 26, yet the cross-sectional area should not be so large so as to prevent clearance of pivot pin 28 when lower leg portion 26 is pivoted with respect to upper leg portion 24.

Lower leg portion 26 has a shape and size which corresponds to the housing formed in upper leg portion 24 for piston 50 to permit telescopic insertion of lower leg portion 26 into upper leg portion 24 when the leg assembly portions are in vertical alignment. Preferably, there is sufficient clearance to permit free telescopic movement and pivoting of lower leg portion 26 when properly positioned, yet not such excessive clearance that would not prevent pivoting of lower leg portion 26 with respect to upper leg portion 24 when there is telescopic engagement of the leg assembly portions. This is accomplished, for example, when upper leg portion 24 is constructed of one inch O.D. by 1/16-inch wall square tubing and lower leg portion 26 of $\frac{3}{4}$-inch O.D.×1/16-inch wall square tubing.

To permit pivoting of lower leg portion 26 with respect to upper leg portion 24, lower leg portion 26 is secured to upper leg portion 24 by means of pivot pin 28 secured transversely through lower leg portion 26 and engaged in vertical slot 30. Upper leg portion 24 has open side 58 corresponding with first extreme end 30*a* of vertical slot 30 so that there is no telescopic engagement or locking of the leg portions in vertical alignment when pivot pin 28 is positioned at first extreme end 30*a*. Lower leg portion 26 has an open side above pivot pin 28 which permits extension of projection 50*b* of piston 50 when lower leg portion 26 is pivoted. For smooth pivoting operation, the side of lower leg portion 26 in contact with projection 50*b* is fitted with hair pin clip 60 which presents a rounded surface for contact with piston 50.

In normal operation, it will be necessary only for the attendant to hold lower leg portion 26 in vertical alignment with upper leg portion 24 during lowering of the bed frame until pivot pin 28 has moved from first extreme end 30*a* to second extreme end 30*b*, thereby locking the leg portions in telescoping engagement and preventing pivoting. For the attendant's convenience in determining when it is no longer necessary to hold lower leg portion in the vertically aligned position, leg assembly 22 is provided with visual indicia 38 corresponding to first extreme end 30*a* of slot 30, the pivotable position of pivot pin 28, and with visual indicia 40 corresponding to second extreme end 30*b* of slot 30, the locked, telescopically engaged position of pivot pin 28.

Preferably, the ledge bed apparatus of the present invention is adapted for use with a patient care bed having a vertically movable bed frame with an inclinable upper torso support section which has an outer end corresponding to the head of the bed frame and an inner end corresponding to about the waist of the patient. For such adaptation, the mattress support member has a first end and a second end adapted to respectively correspond approximately to the outer end and the inner end of the upper torso support section when the mattress support member is positioned on the upper torso support section. In this configuration, the ledge bed apparatus is provided with a plurality of leg assemblies which are attached to the mattress support member at about the second end which corresponds to the inner end of the upper torso support section which also corresponds to about the waist of the patient.

Figure 3:
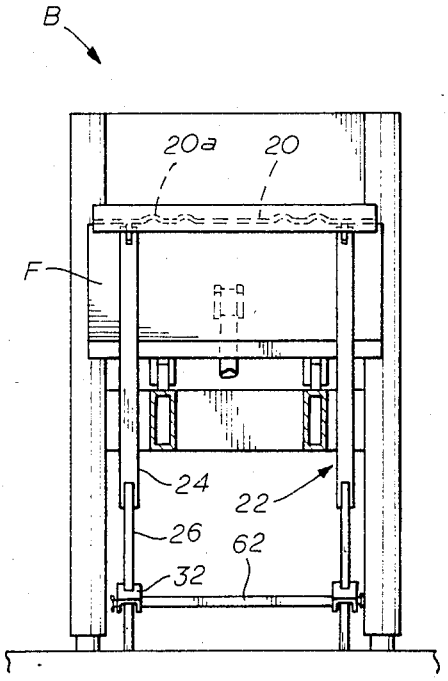
FIG. 3 is a sectional view of the patient care bed of FIG. 2 as seen along the lines 3—3.
Figure 9:
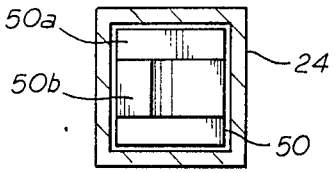
FIG. 9 is a cross-sectional view of the leg assembly of FIG. 6 as seen along the lines 9—9.
Figure 5:
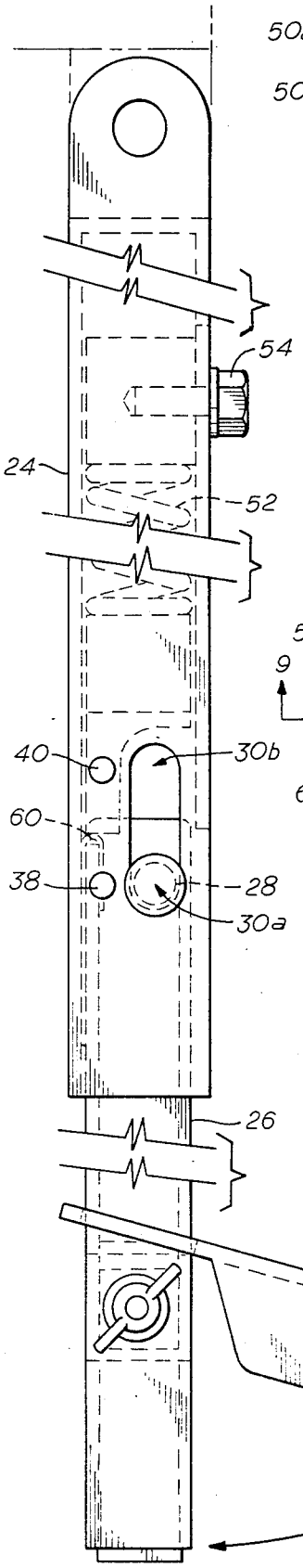
FIG. 5 is a side perspective view of a leg assembly pivoted into the operable position prior to vertical loading thereof according to the present invention.
Figure 6:
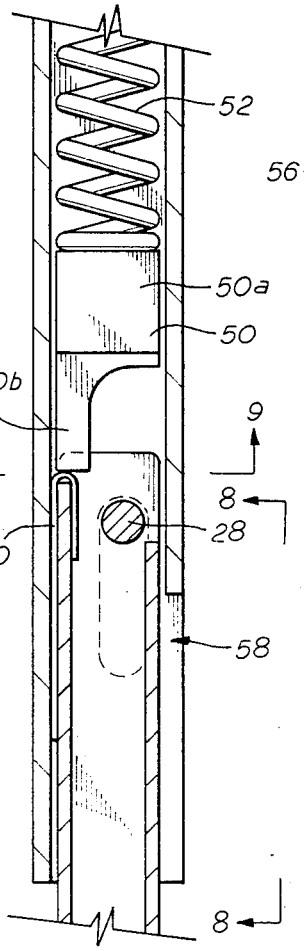
FIG. 6 is a side sectional view of the connection of the upper and lower portion of a leg assembly locked into vertical alignment by telescopic engagement and vertically loaded according to the present invention.
Figure 4:
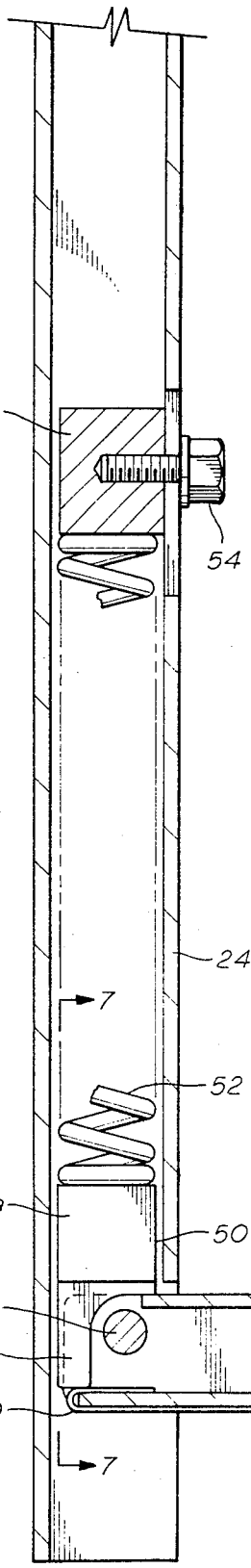
FIG. 4 is a side sectional view of a leg assembly in the inoperable position according to the present invention.
Figure 7:
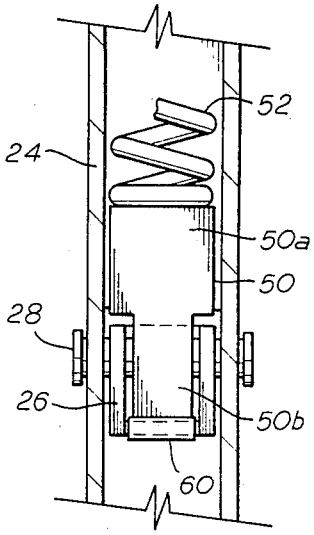
FIG. 7 is a side sectional view of the leg assembly of FIG. 4 as seen along the lines 7—7.
Figure 8:
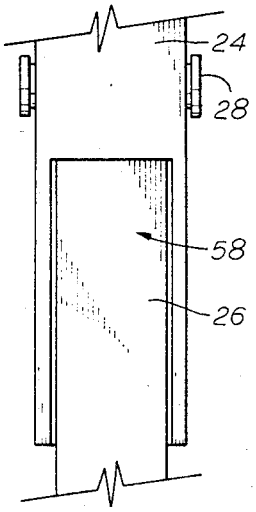
FIG. 8 is a perspective view of the leg assembly of FIG. 6 as seen along the lines 8—8.

Preferably, there are two leg assemblies which are attached at opposite sides of the second end of the mattress support member. For stability and to facilitate pivoting by a single manual operation, leg assemblies 22 are maintained in laterally spaced relation at the lower ends thereof by means of transverse member 62 connected to lower leg portion 26 at about the lower end thereof, as seen in FIG. 3. In this embodiment, at least one of the leg assemblies must be provided with the cylindrical housing and spring-loaded piston described above; however, it is preferable to provide each leg assembly with the automatic releasing means. Also, when the ledge bed apparatus is used with a bed having an inclinable upper torso support section, it is preferable to attach the leg assemblies at 34 pivotally to permit the leg assemblies to depend substantially vertically from mattress support member 20 regardless of the angle of inclination of the upper torso support section.

For the comfort of the patient, it is preferable to form a ledge which is substantially horizontal. When the ledge bed apparatus is used with a bed having an inclinable upper torso support section, a horizontal ledge can be formed by inclining the upper torso support section sufficiently to elevate the outer end or head of the patient to correspond to the height at which the waist or the second end of the mattress support member is maintained by the leg assemblies to form the ledge. Typically, this required inclination will be about 15°–30° from the horizonal. It will also be readily appreciated that a mattress will normally be employed on the bed between the frame of mattress support member 20 and the patient.

When the ledge bed apparatus is incorporated into the integral structure of the bed, mattress support member 20 may be of any size and shape typically used in patient care beds to support a mattress. When it is an overlay device adapted for cooperative use with a conventional patient care bed, mattress support member 20 preferably has a planar shape. To facilitate construction with lightweight materials, longitudinal reinforcing ribs 20*a* may be provided for additional strength.

While I have described and illustrated various preferred embodiments of my invention, those skilled in the art will recognize various modifications. For example, it is possible to have the upper portion of the leg assembly telescope into the lower portion, to have the spring loaded piston housed in the lower leg portion or outside the leg assembly rather than in the upper leg portion, or to have the vertical slot formed in the lower leg portion and the pivot pin extending transversely through the upper leg portion. It is intended that all such modifications which fall within the scope and spirit of the appended claims be embraced thereby.

I claim:

1. A ledge bed apparatus adapted for use with a patient care bed having a vertically movable bed frame, comprising:

(a) a mattress support member adapted to be positioned on the bed frame; and (b) a leg assembly comprising:

(i) an upper leg portion attached to said mattress support member and extending substantially vertically therebeneath, (ii) a lower leg portion pivotally attached to said upper portion and pivotable into substantially vertical alignment therewith, (iii) means for locking said lower leg portion in alignment with said upper leg portion when said lower leg portion is first pivoted into alignment with said upper leg portion and said leg assembly is subsequently vertically loaded by lowering the bed frame so that said lower leg portion engages a load bearing surface and at least a portion of said mattress support member is supported by said leg assembly in a position elevated with respect to the bed frame, thereby forming a ledge; and (iv) automatic means for releasing said locking means and positioning said lower leg portion at an angle with respect to said upper leg portion when said vertical loading is removed by raising said mattress support member so that said lower leg portion is disengaged from said bearing surface, thereby removing said ledge.

2. The apparatus of claim 1, wherein said lower leg portion is adapted not to engage said load bearing surface when the bed frame is lowered unless said lower leg portion is manually pivoted and maintained in alignment with said upper leg portion during said lowering until said leg assembly is vertically loaded.

3. The apparatus of claim 2, wherein said leg portions are adapted for telescopic engagement when vertically aligned and are attached by a pivot pin slidably engaged by a vertical slot formed in said leg assembly.

4. The apparatus of claim 3, wherein said slot has a first extreme end at which said pivot pin may be positioned to pivot said lower portion of said leg assembly and a second extreme end at which said pivot pin may be positioned with said portions of said leg assembly in telescopic engagement to prevent pivoting of said lower leg portion.

5. The apparatus of claim 4, wherein said automatic releasing means comprises a spring-loaded piston which urges said pivot pin to said first extreme end of said slot and said lower leg portion to pivot from alignment with said upper leg portion.

6. A ledge bed apparatus adapted for use with a patient care bed having a vertically movable bed frame with an inclinable upper torso support section which has an outer end corresponding to the head of the bed frame and an inner end corresponding to about the waist of a patient, comprising:

(a) a mattress support member having a first end and a second end adapted to respectively correspond approximately to the outer end and the inner end of the upper torso support section when said mattress support member is positioned on the upper torso support section; and (b) a plurality of leg assemblies, each leg assembly comprising:

(i) an upper leg portion attached to said mattress support member at about said second end, said upper portion extending substantially vertically therebeneath and having a free end;

(ii) a lower leg portion telescopically engageable with said upper leg portion and attached to said free end thereof by a pivot pin slidably engaged by a vertical slot formed in said leg assembly, said slot having a first extreme end at which positioning said pivot pin permits pivoting of said lower leg portion into and from vertical alignment with said upper leg portion, and a second extreme end at which said pivot pin may be positioned by first pivoting said lower leg portion into vertical alignment with said upper portion with said pivot pin positioned at said first extreme end and subsequently vertically loading said leg assembly by lowering the bed frame from an elevated position at which said lower leg portion assembly does not engage a load bearing surface to a vertical position at which said lower leg portion of said leg assembly engages a load bearing surface so that said second end of said mattress support member is supported by said leg assembly in a position elevated with respect to the inner end of the inclinable upper torso support section of the bed frame, thereby forming a ledge on the bed, said leg assembly portions telescopically engaging and said pivot pin simultaneously sliding from said first extreme end to said second extreme end of said slot, thereby locking said leg assembly portions into vertical alignment; and (iii) automatic means for urging said pivot pin from said second extreme end of said slot to said first extreme end of said slot when said vertical loading is removed from said leg assembly by raising the bed frame so that said second end of said mattress support member is supported by the bed frame, thereby removing said ledge, and for urging said lower leg portion to pivot sufficiently from vertical alignment with said upper leg portion when said lower leg portion is disengaged from said bearing surface by said raising of the bed frame so that a subsequent lowering of the bed frame does not result in engagement of said load bearing surface by said lower leg portion unless said lower leg portion is manually pivoted against said urging means into vertical alignment with said upper leg portion prior to said subsequent lowering of the bed frame.

7. The apparatus of claim 6, wherein each of said leg assemblies is pivotally attached to said mattress support member.

8. The apparatus of claim 6, wherein said leg assemblies are two in number and are attached at opposite sides of said second end of said mattress support member.

9. The apparatus of claim 6, wherein said automatic urging means comprises a spring-loaded piston housed in said leg assembly which imparts a separating force to said leg assembly portions which is eccentric with respect to said pivot pin.

10. The apparatus of claim 9, wherein said piston is housed in said upper leg portion.

11. The apparatus of claim 10, wherein said upper leg portion has an open side corresponding to said first extreme end of said vertical slot.

12. The apparatus of claim 11, wherein said slot is formed in said upper portion of said leg assembly and said pivot pin is secured transversely through said lower portion of said leg assembly.

13. The apparatus of claim 12, wherein said portions of said leg assembly are rectangular in transverse cross-section.

14. A ledge bed apparatus adapted for use with a patient care bed having a vertically movable bed frame with an inclinable upper torso support section which has an outer end corresponding to the head of the bed frame and an inner end corresponding to about the waist of a patient, comprising:

(a) a planar mattress support member having a first end and a second end adapted to respectively correspond approximately to the outer and inner ends of the upper torso support section when said mattress support member is positioned on the upper torso support section;

(b) a pair of leg assemblies, operable when the bed frame is lowered to engage a load bearing surface and to support said second end of said mattress support member at a position elevated with respect to the inner end of the upper torso support section of the bed frame, thereby forming a ledge on the bed, each leg assembly comprising:

(i) an upper leg portion depending from said mattress support member, attached at opposite sides of said second end of said member and having a free end;

(ii) a lower leg portion having an upper end and a lower end, said upper end attached to said free end of said upper leg portion and telescopically engageable therewith;

(iii) a vertical slot formed in said leg assembly at about said attachment of said upper end of said lower leg to said free end of said upper leg portion, said slot having first and second extreme ends; and (iv) a pivot pin slidably engaged by said vertical slot and pivotally attaching said upper and lower leg portions, said pivot pin slidable to said first extreme end of said vertical slot to permit pivoting of said lower leg portion with respect to said upper leg portion, and slidable from said first extreme end of said vertical slot to said second extreme end of said vertical slot by telescopically engaging said upper and lower leg portions with said lower leg portion pivoted into substantially vertical alignment with said upper leg portion;

(c) a cylindrical housing formed in at least one of said leg assemblies;

(d) a spring-loaded piston positioned in said housing for urging said pivot pin to slide from said second extreme end to said first extreme end of said vertical slot and for urging said lower leg portion to pivot with respect to said upper leg portion; and (e) a transverse member attached to said lower leg portions near said lower ends thereof.

15. The apparatus of claim 14, wherein said leg assemblies are pivotally attached to said mattress support member.

16. The apparatus of claim 14, wherein said lower leg portion is adapted to telescope into said upper leg portion.

17. The apparatus of claim 14, wherein said vertical slot is formed in said upper leg portion and said pivot pin is secured transversely through said lower leg portion.

18. The apparatus of claim 14, wherein said cylindrical housing and said piston have corresponding rectangular transverse cross-sections.

19. The apparatus of claim 14, wherein said cylindrical housing is formed in said upper leg portion.

20. The apparatus of claim 14, wherein said upper leg portion has an open side at said free end.

21. The apparatus of claim 14, wherein said piston has a full bore portion corresponding to the transverse cross-sectional shape of said housing and a projecting portion abutting said upper end of said lower leg portion, said abutment eccentric with respect to said pivot pin.

22. The apparatus of claim 21, wherein said lower leg portion is provided with a rounded surface at said abutment with said projecting portion of said piston, and said lower leg portion has an open side to permit extension of said projecting portion of said piston into said lower leg portion when said lower leg portion is pivoted with respect to said upper leg portion.

23. The apparatus of claim 14, further comprising a toe pad positioned on at least one of said lower leg portions proximal said attachment of said transverse members.

24. The apparatus of claim 14, further comprising means for adjusting the compressive force of said spring.

* * * * *